US007828583B2

(12) United States Patent
Ohsumi et al.

(10) Patent No.: US 7,828,583 B2
(45) Date of Patent: Nov. 9, 2010

(54) CONNECTOR WITH AN ALIGNER WITH A FLEXIBLE DEFORMABLE ARM WITH A SLIT

(75) Inventors: Hideki Ohsumi, Utsunomiya (JP); Kazuto Ohtaka, Makinohara (JP); Hideki Honma, Tokyo (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 12/562,863

(22) Filed: Sep. 18, 2009

(65) Prior Publication Data

US 2010/0099295 A1 Apr. 22, 2010

(30) Foreign Application Priority Data

Oct. 20, 2008 (JP) ..... 2008-270090

(51) Int. Cl.
*H01R 13/64* (2006.01)

(52) U.S. Cl. ..... 439/374

(58) Field of Classification Search ..... 439/374, 439/378, 352, 357, 752, 595
See application file for complete search history.

(56) References Cited

U.S. PATENT DOCUMENTS 5,167,534 A * 12/1992 Ohsumi ..... 439/595
5,217,386 A * 6/1993 Ohsumi et al. ..... 439/364
6,416,346 B1 * 7/2002 Nakamura ..... 439/374
6,422,880 B1 * 7/2002 Chiu ..... 439/137
7,347,710 B2 * 3/2008 Ohtaka et al. ..... 439/352
7,591,665 B2 * 9/2009 Nakamura ..... 439/374
2006/0194469 A1 * 8/2006 Miyakawa et al. ..... 439/357
2007/0059968 A1 * 3/2007 Ohtaka et al. ..... 439/352

FOREIGN PATENT DOCUMENTS

JP 10-55844 2/1998

* cited by examiner

*Primary Examiner*—Chandrika Prasad
(74) *Attorney, Agent, or Firm*—Finnegan, Henderson, Farabow, Garrett & Dunner L.L.P.

(57) ABSTRACT

A connector including a first connector accommodating a male terminal, a second connector accommodating a female terminal, and a movable aligner which supports a tip of the male terminal and is movable from a provisional position to a completed position according to the insertion and desertion of the second connector relative to the first connector. At the provisional position, a pushing projection pushes the arm toward the inner wall so that the arm deforms and the regulating projection is in the recess portion, and the movable aligner supports the tip of the first terminal so as to align with the second terminal during a movement between the provisional position to the completed position, the pushing projection is engaged with the slit; and at the completed position, the first and the second terminals are connected. Thus the movable aligner precisely align the male terminal with the female terminal.

16 Claims, 12 Drawing Sheets

CONNECTOR WITH AN ALIGNER WITH A FLEXIBLE DEFORMABLE ARM WITH A SLIT

CROSS-REFERENCE TO RELATED APPLICATIONS

This application claims priority from Japanese Patent Application No. 2008-270090 filed on Oct. 20, 2008, the entire subject matters of which are incorporated herein by reference.

TECHNICAL FIELD

This invention relates to a connector used in a vehicle, in which male terminals are fitted to female terminals.

BRIEF DESCRIPTION OF THE RELATED ART

JP-A-10-55844 discloses an electrical connector. As shown in FIGS. 22 to 24, this electrical connector comprises a connector 201 and a connector 203. The connector 201 for receiving male terminals 205 comprises a housing 207, movable members 209, while the connector 203 for receiving female terminals 211 comprises housings 213. For fitting the connector 201 and 203 together, each movable member 209 is held in a terminal fitting starting position within the housing 207, and supports distal end portions of pins 217 of the male terminals 205 by respective pin passage holes 215 so as to position (or align) the male terminals 205 relative to the female terminals 211. After the male terminals 205 are properly fitted to the respective female terminals 211, the movable member 209 is pushed by the connector 203 to be moved to an inner end surface of the housing 207.

The movable member 209 has three pairs of arms 219, 221 and 223 formed at each end thereof. At the time of releasing the connector 203 from the connector 201, the arm 219 is retainingly engaged at its distal end with a retaining projection 225 formed on the housing 207, thereby preventing the movable member 209 from being withdrawn from the housing 207. The arm 221 has a groove 227 which is engaged with a retaining projection 229 of a triangular shape which is formed on the housing 213 of the connector 203 so as to cause the movable member 209 to be moved from the inner end surface of the housing 207 to the terminal fitting starting position at the time of releasing the connector 203 from the connector 203. The arm 223 has a groove 231 which is engaged with a retaining projection 233 (formed on the housing 207 and having slanting surfaces slanting respectively in the fitting direction and the releasing direction) so as not to move the movable member 209 from the terminal fitting starting position when starting the fitting of the pins 217 of the male terminal 205 to the respective female terminals 211.

The engagement of the groove 231 of the arm 223 with the retaining projection 233 is canceled when the movable member 209 is pushed by the connector 203 and begins to move from the terminal fitting starting position toward the inner end surface. The movable member 209 is again brought into engagement with the retaining projection 233 when the movable member 209 returns from the inner end surface to the terminal fitting starting position.

When the connector 201 is to be fitted to the connector 203 (that is, the male terminals 205 are to be fitted to the respective female terminal 211), it is necessary to hold the movable member 209 in the terminal fitting starting position. However, this holding function depends on the force of engagement between the arm 223 (that is, the groove 231) and the retaining projection 233 having the slanting surfaces. Therefore, when the force of engagement of the retaining projection 233 with the groove 231 is increased, for example, by increasing the height of the retaining projection 233, the force required for fitting the connectors 201 and 203 together is accordingly increased, so that the efficiency of the operation is lowered. On the other hand, when this engagement force is decreased by reducing the height of the retaining projection 233, there is a possibility that the movable member 209 moves from the terminal fitting starting position toward the inner end surface before the male terminals 205 are properly fitted to the respective female terminal 211. In such a case, the function of positioning (or aligning) the distal end portions of the male terminals 205 (that is, the pins 217) is lowered, and the pins 217 are deformed by interference with the female terminals 211, and therefore the proper fitted condition can not be expected.

Furthermore, the function of moving the movable member 209 from the inner end surface of the housing 207 to the terminal fitting starting position depends on the force of engagement between the triangular retaining projection 229 of the connector 203 and the arm 221 (that is, the groove 227). Therefore, when the force of engagement of the retaining projection 229 with the groove 227 is increased, for example, by increasing the height of this retaining projection 229, the force required for fitting the connectors 201 and 203 together is accordingly increased, so that the efficiency of the operation is lowered. On the other hand, when this engagement force is decreased by reducing the height of the retaining projection 229, the engagement of the arm 221 (that is, the groove 227) with the retaining projection 229 is released, so that the movable member 209 can not be returned to the terminal fitting starting position, and when the connector 201 and the connector 203 are again fitted together, the function of positioning the male terminal 205 (or pins 217) is lowered, and therefore the proper fitted condition can not be expected.

Furthermore, the arms 219 are provided for preventing the withdrawal of the movable member 209, and the arms 221 are provided for returning the movable member 209 to the terminal fitting starting position, and the arms 223 are provided for holding the movable member 209 in the terminal fitting starting position. Thus, because the three pairs of arms 219, 221 and 223 are provided, not only the movable member 209 but also the connectors 201 and 203 as a whole are increased in size.

SUMMARY

It is therefore an object of this invention to provide a connector in which when performing a connecting operation, male terminal can be aligned with respective female terminals by a movable aligner, and when canceling the fitted condition, the movable aligner can be positively returned to a predetermined position (a provisional position).

A connector according to the first aspect of the present invention is a connector including a first connector including a connector body in which a first terminal is accommodated and a hood portion to which a tip of the first terminal is exposed, the hood portion including an inner wall on which a recess portion is provided; a second connector to be inserted into and deserted from the hood portion, which accommodates a second terminal and has a pushing projection; and a movable aligner movable between a provisional position and a completed position by the insertion and desertion of the second connector into the hood portion, and including an arm which is flexibly deformable toward the inner wall, the arm including a slit and a regulating projection. At the provisional position, the pushing projection pushes the arm toward the inner wall so that the arm deforms and the regulating projection is in the recess portion, and the movable aligner supports the tip of the first terminal so as to align with the second terminal. During a movement between the provisional position to the completed position, the pushing projection is engaged with the slit. At the completed position, the first and the second terminals are connected.

According to the first aspect of the invention, when fitting the female terminal to the male terminal, the pushing projection of the second connector pushes the arm of the movable aligner which is disposed at the provisional position, so that the arm deforms and the regulating projection in the recess portion. (At the provisional position, the distal end portions of the male terminals begin to be fitted to the respective male terminals). Thus the regulating projection is retained in the recess portion of the hood portion to hold the movable aligner in the provisional position. Therefore, the female terminal and the male terminal are properly fitted together by the movable aligner which supports the tip of the male terminal so as to align with the respective female terminals. Thereafter, the movable aligner is moved to the completed position by the pushing projection engaged in the restorable arm slit.

For canceling the fitted condition, when the second connector is moved toward the opening of the hood portion, the fitted condition of the female terminal and male terminal is canceled, and further the movable aligner is moved from the completed position to the provisional position by the pushing projection through the restorable arm. In the provisional position, the pushing projection pushes the arm so that the regulating projection is in the recess portion. Thereby the movable aligner is prevented from being withdrawn from the hood portion.

Thus, in the fitting operation, the male terminal can be aligned with the female terminal by the movable aligner, and in the fitting cancellation operation, the movable aligner can return to the predetermined provisional position and can be held at the position.

And addition, in contrast with the related connector using the three pairs of arms, the connector of the invention is prevented from becoming large in size.

According to a second aspect of the present invention, in the connector according to the first aspect, the hood portion includes a regulating rib which contacts with the regulating projection to prevent the arm from deforming.

According to the second aspect of the invention, advantages similar to those of the first aspect of the invention can be achieved.

In addition, during the movement of the movable aligner from the completed position to the provisional position, the rib formed on the hood portion contacts the regulating projection to prevent the arm from deforming. Thus, the disengagement of the pushing projection from the slit (which would otherwise be caused by this displacement) is prevented. Thereby, the movable aligner is prevented from being left in a intermediate position between the completed position and the provisional position.

Therefore, when the first connector and the second connector are to be again fitted together, the movable aligner is held in the provisional position and aligns the male terminal with the female terminal so that the male terminal can be properly fitted to the respective female terminal.

According to a third aspect of the present invention, in the connector according to the first and second aspect, the pushing projection includes a slant surface contacting with the arm at the provisional position.

According to the third aspect of the invention, advantages similar to those of the first aspect or the second aspect of the invention can be achieved.

In addition, thanks to a wedge effect of the slanting surface formed on the pushing projection, the function of the pushing projection (which is brought into contact with the arm so as to retain the regulating projection in the recess portion to hold the movable aligner in the provisional position) is enhanced. Therefore, when fitting the first connector and the second connector together, the male terminals can be aligned respectively with the female terminal by the movable aligner. When canceling the fitted condition, the movable aligner can be prevented from being withdrawn from the hood portion.

According to a fourth aspect of the invention, in the connector according to the first, second, and third aspect of the invention, the movable aligner includes a guide rib and second connector includes a guide groove with which the guide rib is engaged so as to guide the movement of the movable aligner between the provisional position and the completed position.

According to the fourth aspect of the invention, advantages similar to those of any one of the first to third aspects of the invention can be achieved.

In addition, the movable aligner is guided by the guide groove through the guide rib, and is prevented from being inclined from a direction in which the movable aligner should move. Therefore, the movable aligner can be smoothly moved between the provisional position and the completed position.

According to a fifth aspect of the invention, in the connector according to the first, second, third, and fourth aspect, the movable aligner includes an retaining arm the hood portion includes a provisional retaining portion provided at a position corresponding to the provisional position of the movable aligner and a completed engaging portion provided at a position corresponding to the completed position of the movable aligner. The retaining arm is retained to the provisional retaining portion and the completed retaining portion when the movable aligner is at the provisional position and the completed position respectively.

According to the fifth aspect of the invention, advantages similar to those of any one of the first to fourth aspects of the invention can be achieved.

In addition, the movable aligner is held in the provisional position by the retaining arm engaged with the provisionally retaining portion of the hood portion, and also is held in the completed position by the retaining arm engaged with the completely retaining portion of the hood portion. Particularly thanks to the function of holding the movable aligner in the provisional position, the function of aligning the male terminal with the respective female terminal is properly maintained.

Furthermore, in the operation for inserting the second connector into the first connector, when the pushing projection of the second connector makes the regulating projection of the terminal deformation prevention member (disposed in the provisional position) to be retained in the provisionally-retaining recess, the retaining engagement of the retaining arm with the provisionally-retaining portion positively prevents the movable aligner from being accidentally moved toward the completed position. Also, when deserting the second connector from the second connector, the retaining engagement of the retaining arm with the completely-retaining portion positively prevents the movable aligner from being withdrawn from the fitting hood portion.

According to a sixth aspect of the present invention, in the connector of the first, second, third, fourth, and fifth aspects, the movable aligner includes a guiding portion and the hood portion includes a sliding wall on which the guiding portion slides during the movement of the movable aligner between the provisional position and the completed position.

According to the sixth aspect of the invention, advantages similar to those of any one of the first to fifth aspects of the invention can be achieved.

And besides, during the movement of the movable aligner between the provisional position and the completed position, the guiding wall guides the guide portion, thereby preventing the movable aligner from being inclined, and therefore the movable aligner can be moved smoothly, and the function of aligning the male terminal with the respective female terminal in the provisional position is normally maintained.

DETAILED DESCRIPTION OF EXEMPLARY EMBODIMENTS OF THE PRESENT INVENTION

Exemplary Embodiment

Figure 1:
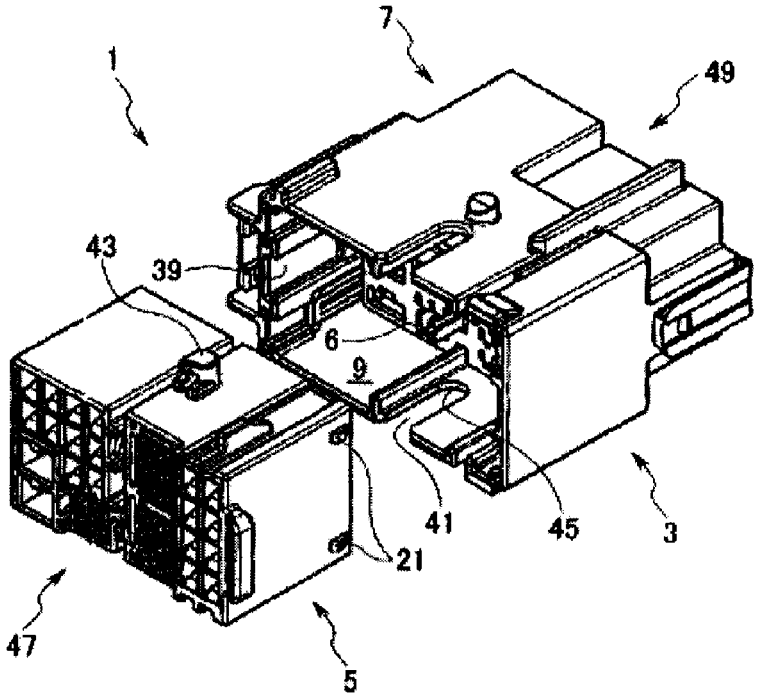
FIG. 1 is a perspective view showing a female connector 3 and a male connector 5 before they are fitted together.
Figure 2:
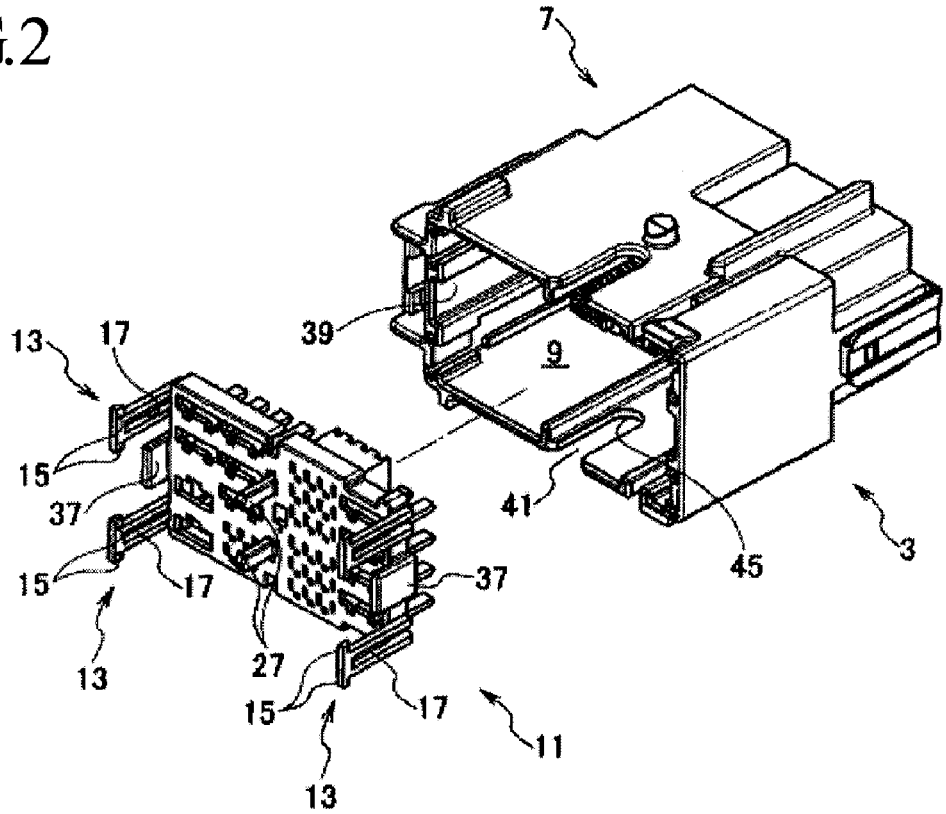
FIG. 2 is a perspective view showing a connector body 7 and a movable aligner 11 of the female connector 3.
Figure 3:
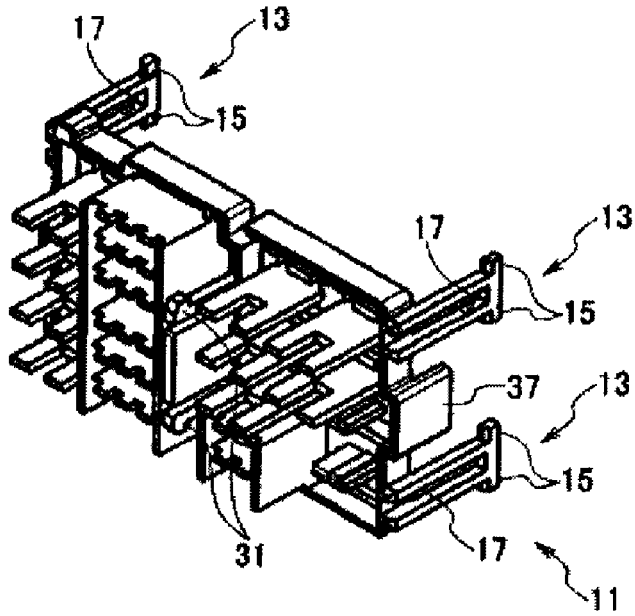
FIG. 3 is a perspective view of the movable aligner 11 as seen from a direction opposite to that of FIG. 2.
Figure 4:
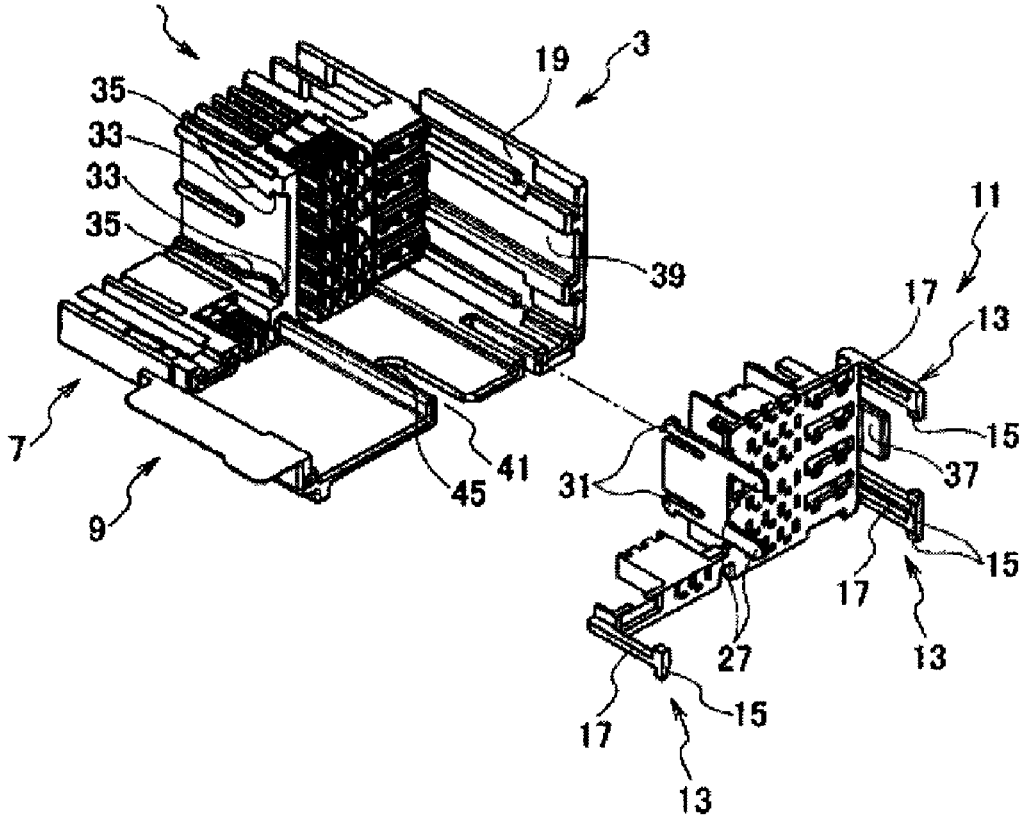
FIG. 4 is a partly-broken, perspective view showing the female connector 3 and the movable aligner 11.
Figure 5:
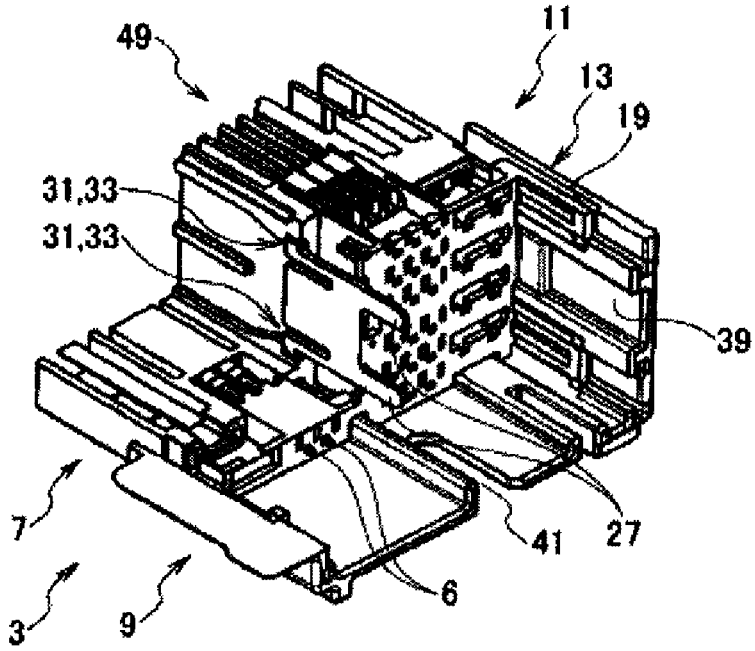
FIG. 5 is a partly-broken, perspective view showing the female connector 3 and the movable aligner 11 held in a provisional position.
Figure 6:
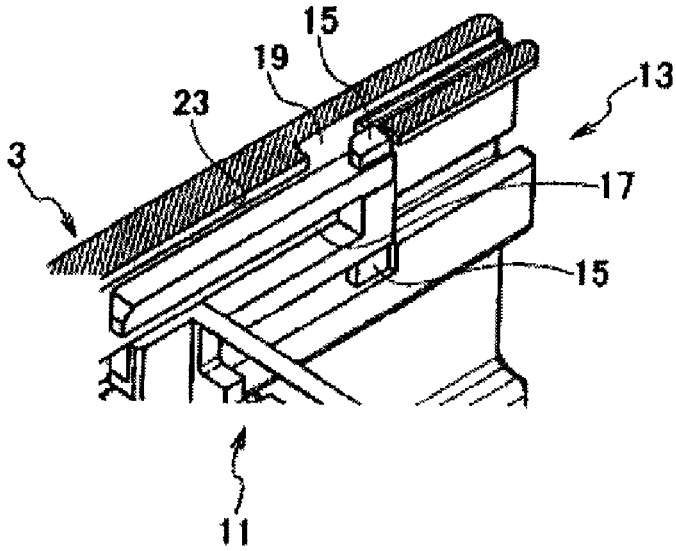
FIG. 6 is a perspective view showing a arm 13 and a recess portion 19 when the movable aligner 11 is disposed in the provisional position.
Figure 7:
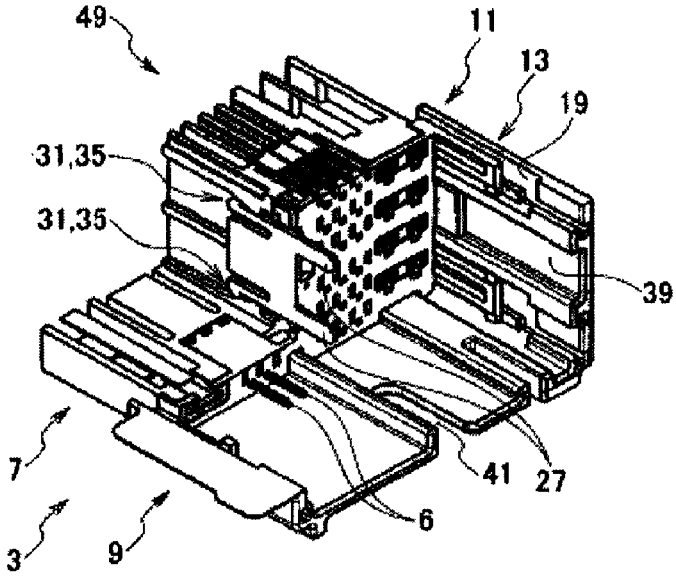
FIG. 7 is a partly-broken, perspective view showing the female connector 3 and the movable aligner 11 held in a completed position.
Figure 8:
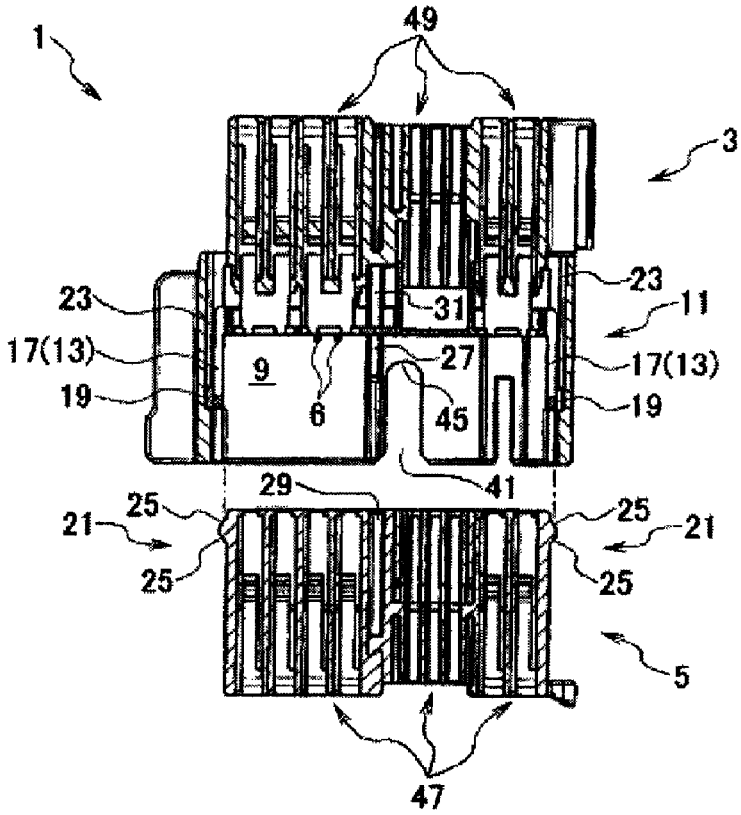
FIG. 8 is a cross-sectional view showing the female connector 3 and the male connector 5 before they are fitted together.
Figure 9:
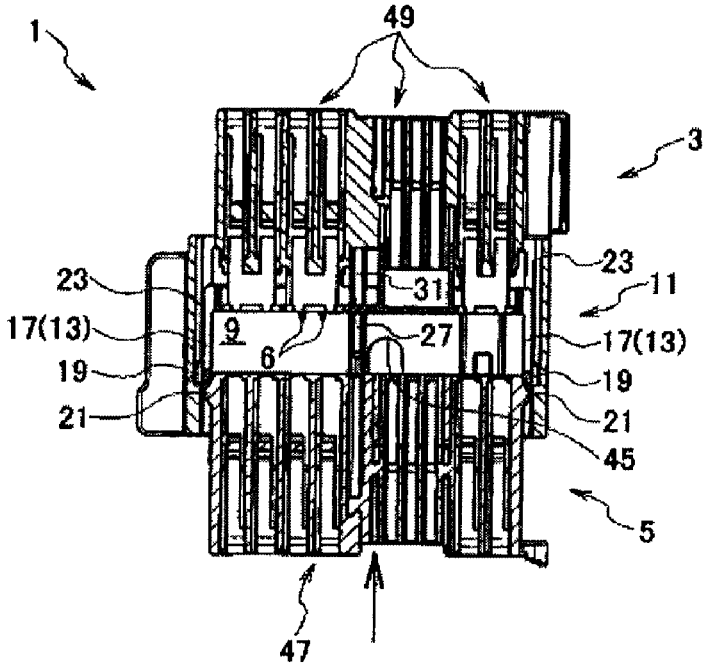
FIG. 9 is a cross-sectional view showing a condition in which pushing projections 21 of the male connector 5 inserted in a hood portion 9 of the female connector 3 begin to press the arms 13, respectively.
Figure 10:
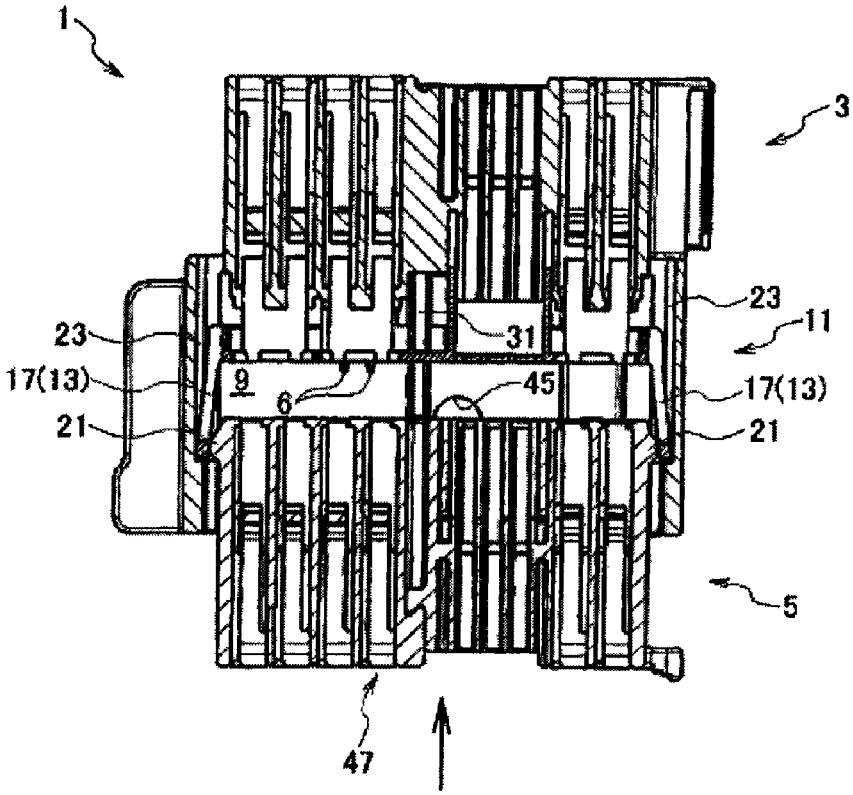
FIG. 10 is a cross-sectional view showing a condition in which each pushing projection 21 presses the arm 13 to cause regulating projections 15 to be retained in the recess portion 19.
Figure 11:
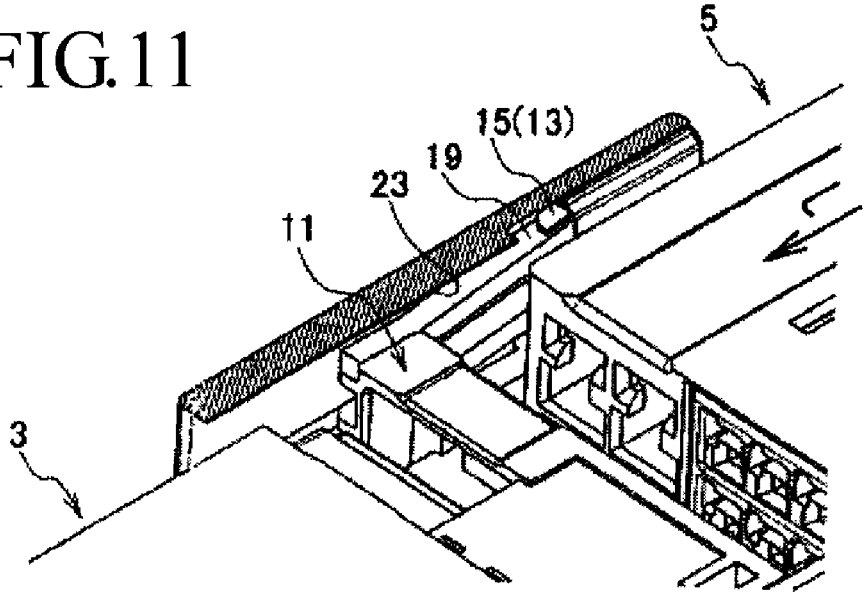
FIG. 11 is a perspective view showing the condition of FIG. 10.
Figure 12:
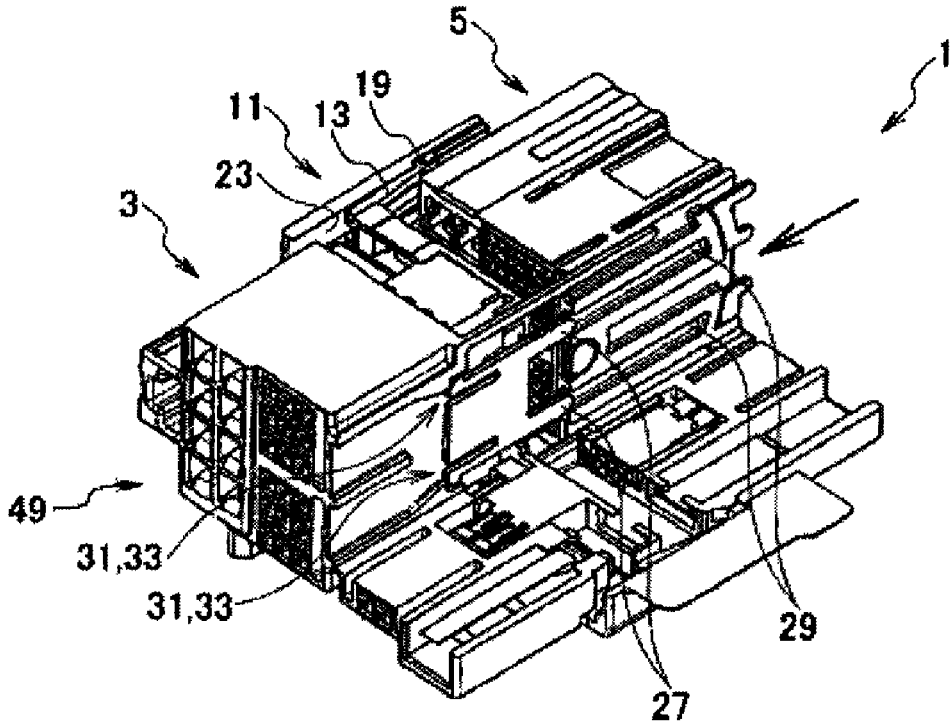
FIG. 12 is a partly-broken, perspective view showing the female connector 3, the movable aligner 11 and the male connector 5 in the condition of FIGS. 10 and 11.
Figure 13:
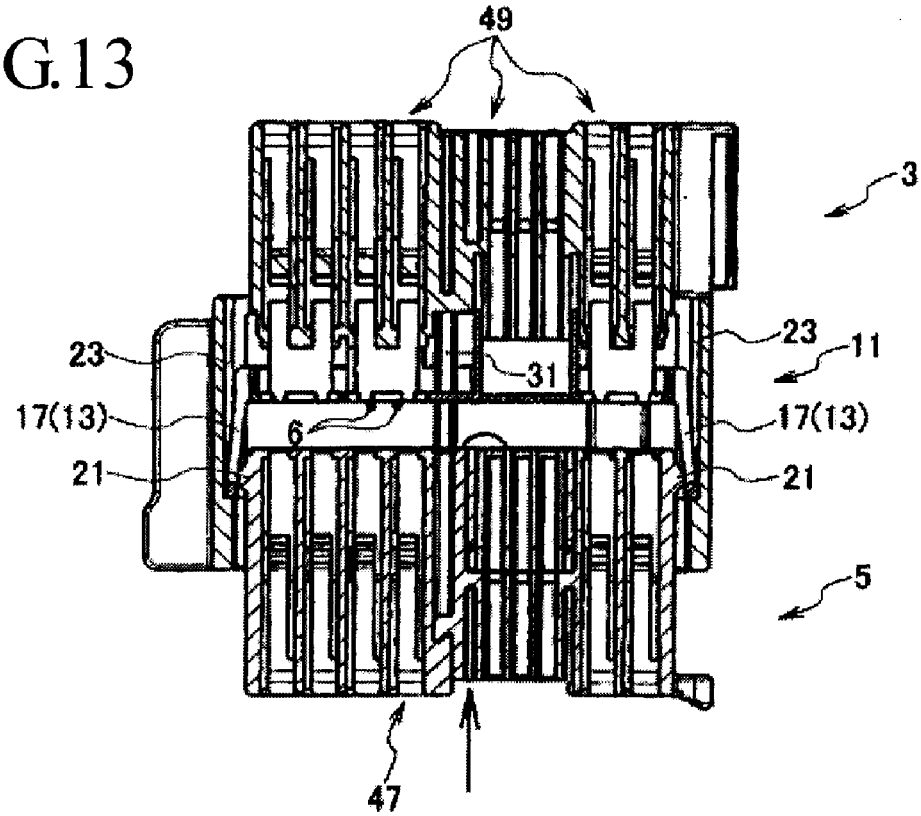
FIG. 13 is a cross-sectional view showing a condition in which each pushing projection 21, after causing the regulating projections 15 of the arm 13 to be retained in the recess portion 19, is engaged in a slit 17.
Figure 14:
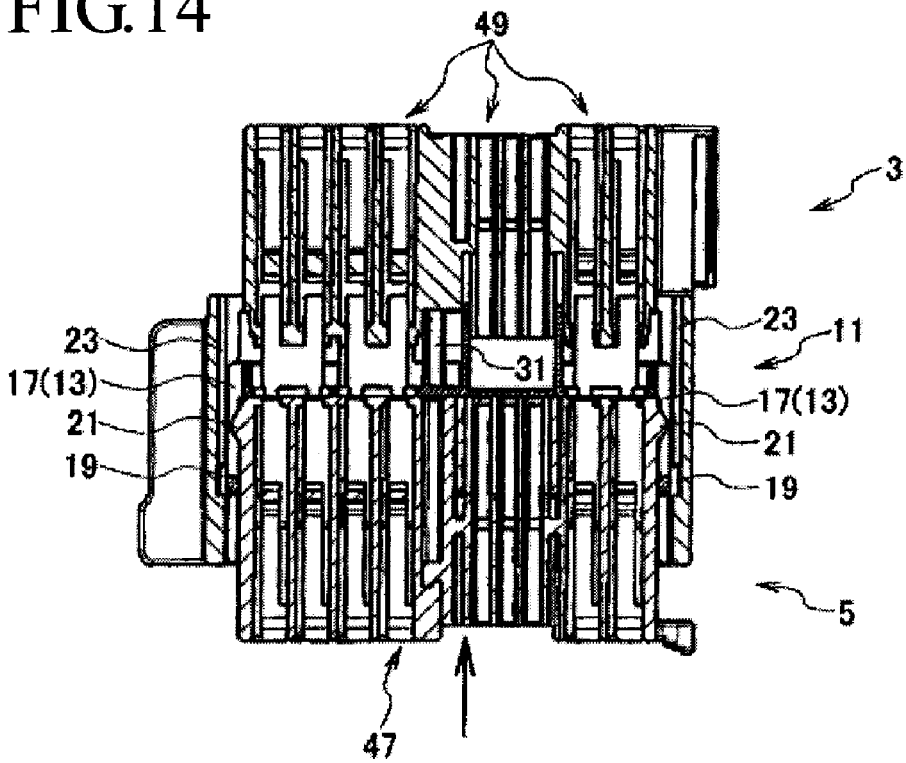
FIG. 14 is a cross-sectional view showing a condition in which the male connector 5 contacts the movable aligner 11, and male terminals 6 begin to fit to respective female terminals.
Figure 15:
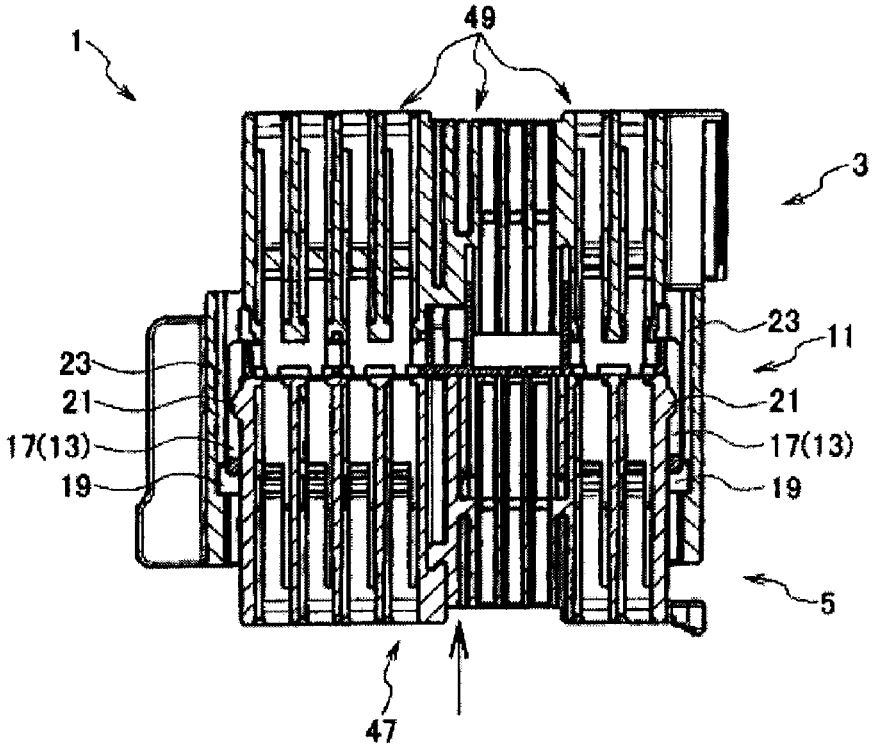
FIG. 15 is a cross-sectional view showing a condition in which the fitting of the male terminals 6 to the respective female terminals proceeds while the male connector 5 pushes the movable aligner 11 toward the completed position.
Figure 16:
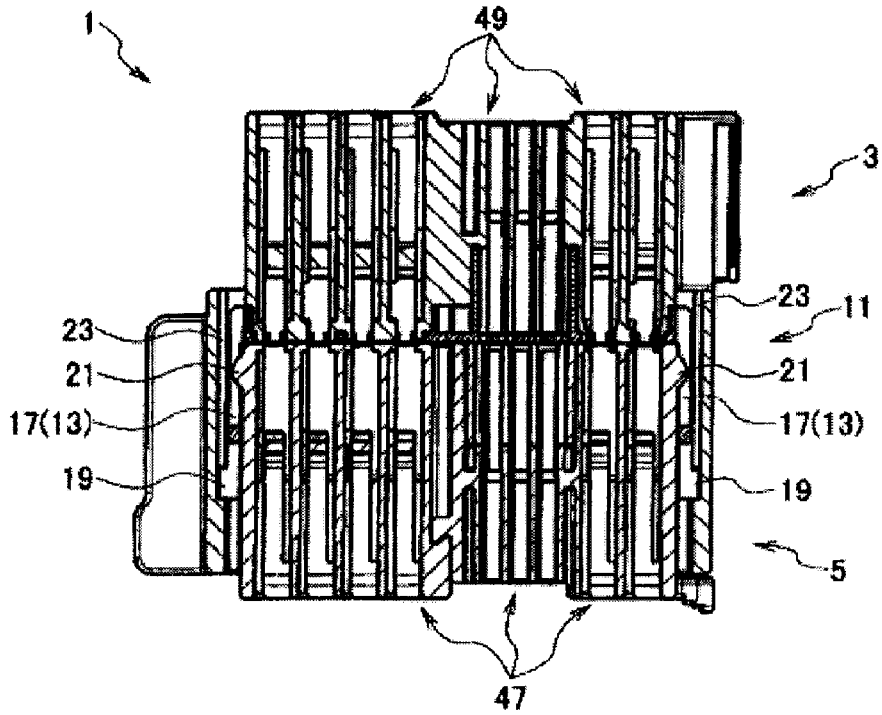
FIG. 16 is a cross-sectional view showing a condition in which the movement of the movable aligner 11 to the completed position, as well as the fitting of the male terminals 6 to the respective female terminals, is completed.
Figure 17:
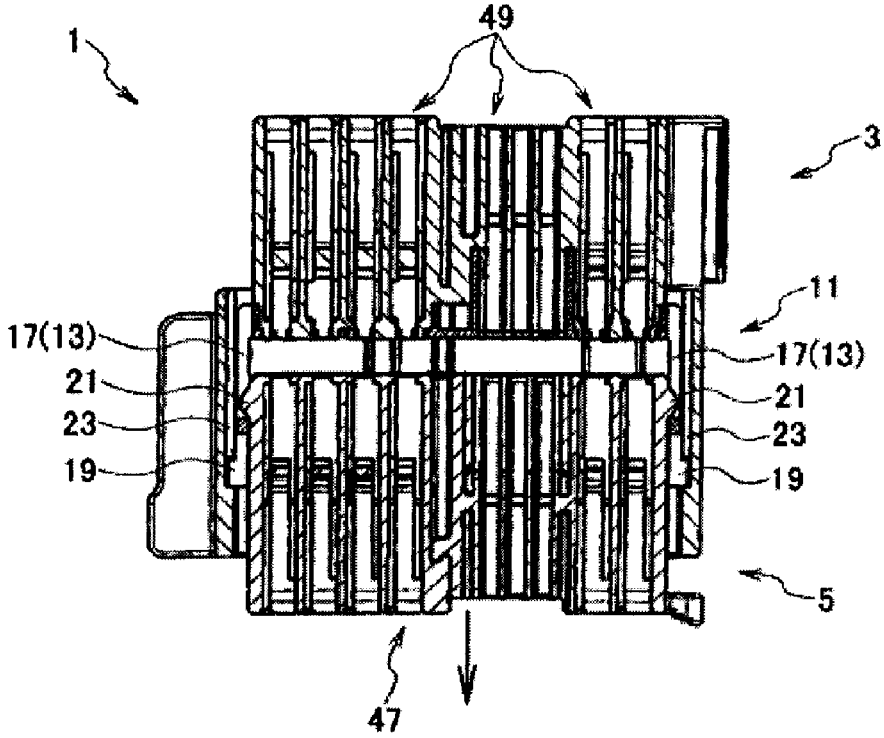
FIG. 17 is a cross-sectional view showing a condition in which the cancellation of the fitted condition of the female connector 3 and male connector 5 begins, and the male connector 5 moves the movable aligner 11 toward the provisional position by the pushing projections 21 engaged respectively in the slits 17.
Figure 18:
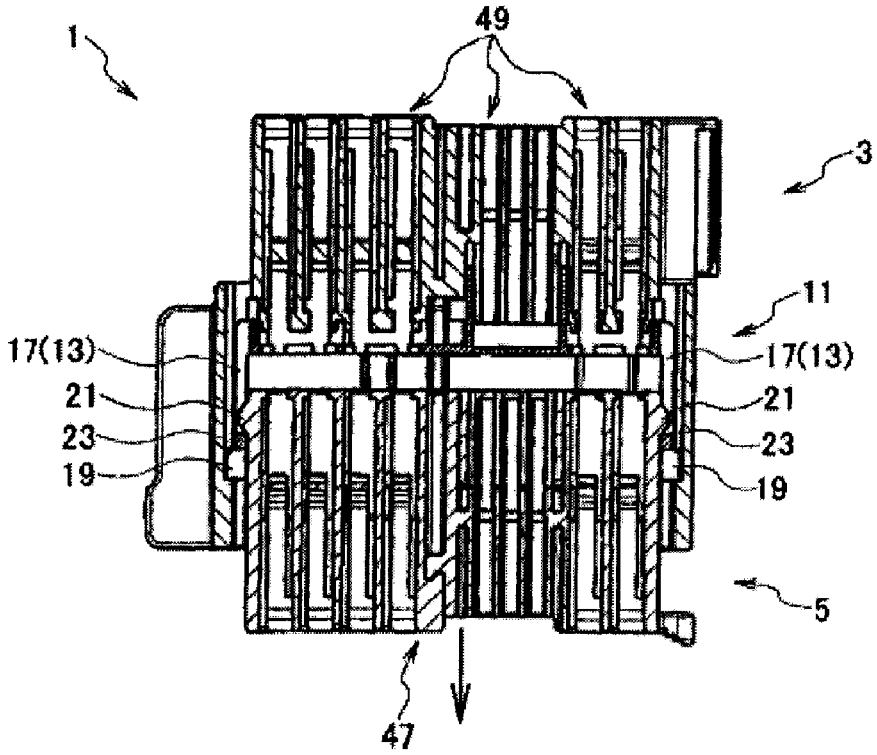
FIG. 18 is a cross-sectional view showing a condition in which the movable aligner 11 is returned to a position just before the provisional position.
Figure 19:
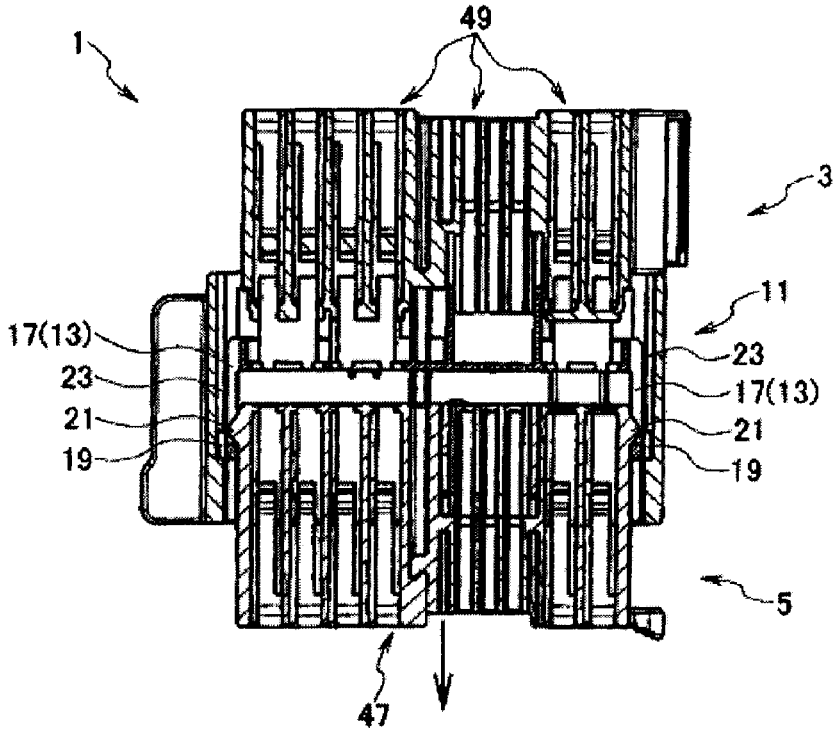
FIG. 19 is a cross-sectional view showing a condition in which the movable aligner 11 is returned to the provisional position, and each pushing projection 21 begins to press the arm 13.
Figure 20:
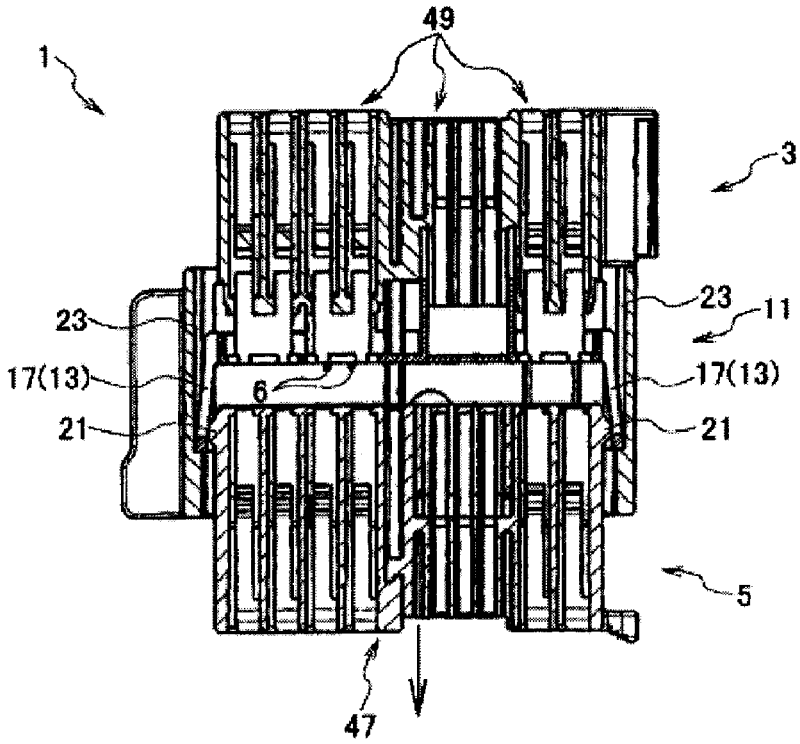
FIG. 20 is a cross-sectional view showing a condition in which each pushing projection 21 presses the arm 13 to cause the regulating projections 15 to be retained in the recess portion 19.
Figure 21:
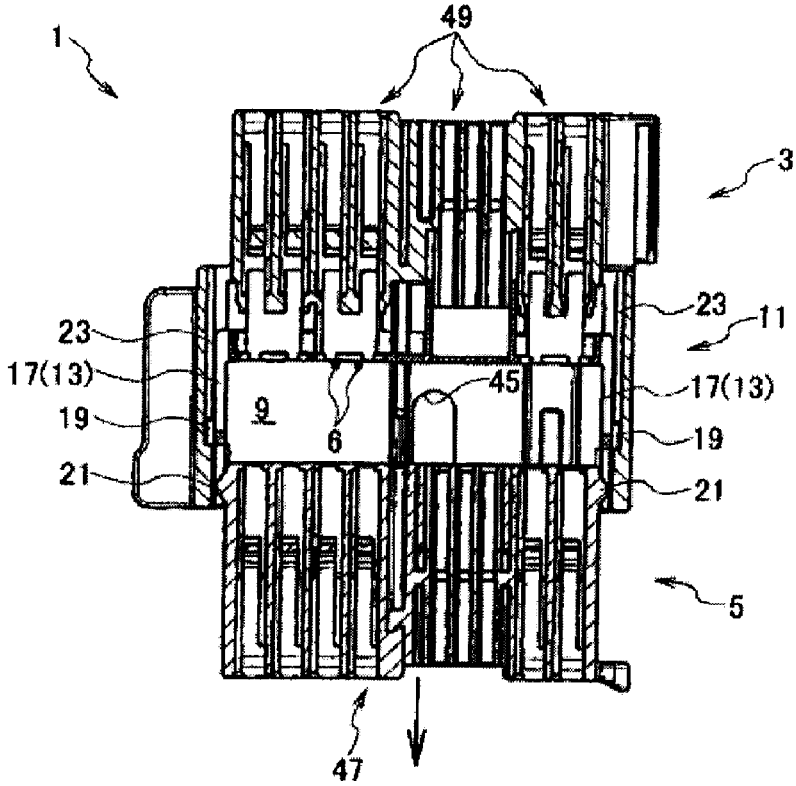
FIG. 21 is a cross-sectional view showing a condition in which the movable aligner 11 is held in the provisional position by its retaining engagement with the recess portions 19, and also the engagement of each pushing projection 21 with the slit 17 is canceled, so that the male connector 5 is moved toward an opening of the hood portion 9.
Figure 22:
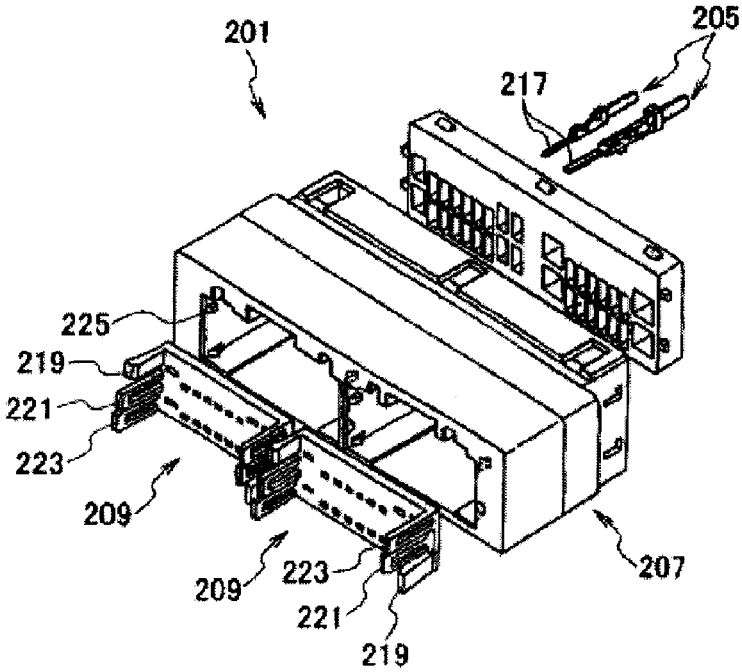
FIG. 22 is an exploded perspective view of a conventional male terminal-receiving connector.
Figure 23:
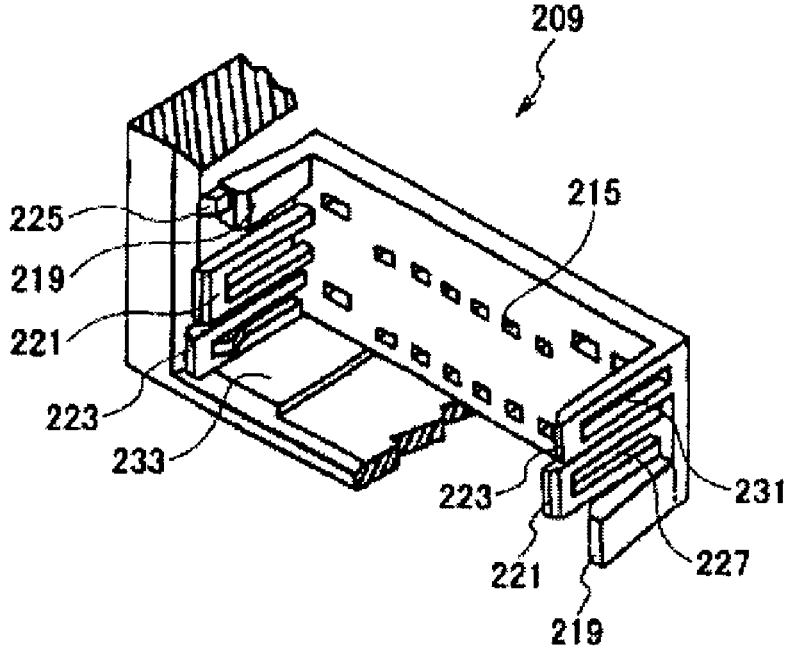
FIG. 23 is a perspective view showing a member of the male terminal-receiving connector.
Figure 24:
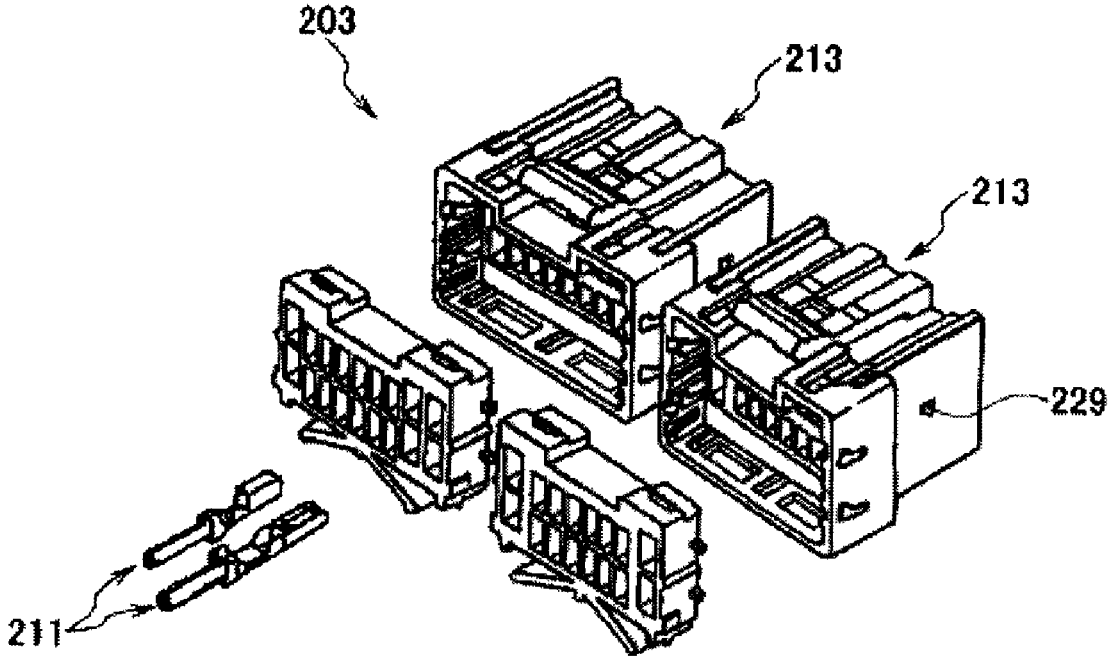
FIG. 24 is an exploded perspective view of a conventional female terminal-receiving connector.

One exemplary embodiment of a connector 1 of the present invention will now be described with reference to FIGS. 1 to 21. FIG. 1 is a perspective view showing a female connector 3 and a male connector 5 before they are fitted together, FIG. 2 is a perspective view showing a connector body 7 and a movable aligner 11 of the female connector 3, FIG. 3 is a perspective view of the movable aligner 11 as seen from a direction opposite to that of FIG. 2, FIG. 4 is a partly-broken, perspective view showing the female connector 3 and the movable aligner 11, FIG. 5 is a partly-broken, perspective view showing the female connector 3 and the movable aligner 11 held in a provisional position, FIG. 6 is a perspective view showing a arm 13 and a recess portion 19 when the movable aligner 11 is disposed in the provisional position, FIG. 7 is a partly-broken, perspective view showing the female connector 3 and the movable aligner 11 held in a completed position, FIG. 8 is a cross-sectional view showing the female connector 3 and the male connector 5 before they are fitted together, FIG. 9 is a cross-sectional view showing a condition in which pushing projections 21 of the male connector 5 inserted in a hood portion 9 of the female connector 3 begin to press the arms 13, respectively, FIG. 10 is a cross-sectional view showing a condition in which each pushing projection 21 presses the arm 13 to cause regulating projections 15 to be retained in the recess portion 19, FIG. 11 is a perspective view showing the condition of FIG. 10, FIG. 12 is a partly-broken, perspective view showing the female connector 3, the movable aligner 11 and the male connector 5 in the condition of FIGS. 10 and 11, FIG. 13 is a cross-sectional view showing a condition in which each pushing projection 21, after causing the regulating projections 15 of the arm 13 to be retained in the recess portion 19, is engaged in a slit 17, FIG. 14 is a cross-sectional view showing a condition in which the male connector 5 contacts the movable aligner 11, and male terminals 6 begin to fit to respective female terminals, FIG. 15 is a cross-sectional view showing a condition in which the fitting of the male terminals 6 to the respective female terminals proceeds while the male connector 5 pushes the movable aligner 11 toward the completed position, FIG. 16 is a cross-sectional view showing a condition in which the movement of the movable aligner 11 to the completed position, as well as the fitting of the male terminals 6 to the respective female terminals, is completed, FIG. 17 is a cross-sectional view showing a condition in which the cancellation of the fitted condition of the female connector 3 and male connector 5 begins, and the male connector 5 moves the movable aligner 11 toward the provisional position by the pushing projections 21 engaged respectively in the slits 17, FIG. 18 is a cross-sectional view showing a condition in which the movable aligner 11 is returned to a position just before the provisional position, FIG. 19 is a cross-sectional view showing a condition in which the movable aligner 11 is returned to the provisional position, and each pushing projection 21 begins to press the arm 13, FIG. 20 is a cross-sectional view showing a condition in which each pushing projection 21 presses the arm 13 to cause the regulating projections 15 to be retained in the recess portion 19, and FIG. 21 is a cross-sectional view showing a condition in which the movable aligner 11 is held in the provisional position by its retaining engagement with the recess portions 19, and also the engagement of each pushing projection 21 with the slit 17 is canceled, so that the male connector 5 is moved toward an opening of the hood portion 9.

The connector 1 includes the female (first) connector 3 which includes the connector body 7 for receiving the male terminals 6 and the hood portion 9 which is formed integrally with the connector body 7 and into which distal end portions of the male terminals 6 project, the male (second) connector 5 which receives the female terminals and can be inserted into the hood portion 9, and the movable aligner 11 which is movable within the hood portion 9 between the provisional position where the movable aligner 11 supports the distal end portions of the male terminals 6 so as to align these distal end portions with the respective female terminals and the completed position where the fitting of the male terminals 6 to the respective female terminals is completed.

Four arms 13 displaceable toward an inner surface of the hood portion 9 are formed on the movable aligner 11, and each restorable arm 11 has the regulating projections 15 and the slit 17. The recess portions 19 are formed in the inner surface of the hood portion 9, and when the movable aligner 11 is disposed in the provisional position, each recess portion 19 can receive the corresponding regulating projections 15 so as to displace the arm 13, and also can retain the regulating projections 15 to prevent the movement of the movable aligner 11 and the withdrawal of the movable aligner 11 from the hood portion 9.

The male connector 5 has the pushing projections 21 each of which can press the arm 13 to retract the regulating projections 15 into the recess portion 19 and also can be engaged in the slit 17 of the arm 13.

For fitting the female terminals to the respective male terminals 6, the male connector 5 is inserted into the hood portion 9, and the pushing projections 21 press the respective arms 13 of the movable aligner 11 to displace them, thereby causing the regulating projections 15 of each arm 13 to be retained in the recess portion 19, and further each pushing projection 21 is engaged in the slit 17, and in this condition the fitting of the female terminals to the respective male terminals 6 is started while the male connector 5 pushes the movable aligner 11, and then the movable aligner 11 is further moved by the male connector 5 to the completed position, thus completing the fitting of the female terminals to the respective male terminals 6.

For canceling the fitted condition of the female terminals and male terminals 6, the male connector 5 is moved toward the opening of the hood portion 9 while canceling the fitted condition of the female terminals and male terminals 6, and the male connector 5 moves the movable aligner 11 from the completed position to the provisional position by the pushing projections 21 through the arms 13, and in the provisional position, each pushing projection 21 causes the corresponding regulating projections 15 to be retained in the recess portion 19, thereby holding the movable aligner 11 in the provisional position to prevent the same from withdrawal from the hood portion 9.

Further, restorable arm displacement limitation ribs 23 are formed on the hood portion 9, and during the returning movement of the movable aligner 11 by the male connector 5 from the completed position to the provisional position, these ribs 23 contact the corresponding regulating projections 15, respectively, to prevent the displacement of the arms 13, thereby preventing the disengagement of each pushing projection 21 from the slit 17 (which otherwise would be caused by this displacement) so as to prevent the movable aligner 11 from being left in a position just before the provisional position (that is, in a position intermediate the provisional position and the completed position).

Further, each pushing projection 21 has slanting surfaces 25 and 25 which contact the arm 13 of the movable aligner 11 in the provisional position to retract the regulating projections 15 of the arm 13 into the recess portion 19.

Further, the movable aligner 11 has guide ribs 27 and 27, and the male connector 5 has guide grooves 29 and 29 for engagement respectively with the guide ribs 27 and 27. The male connector 5 guides the movable aligner 11 through the guide ribs 27 sliding in and along the respective guide grooves 29 so as to prevent the movable aligner 11 from being inclined during the movement thereof between the provisional position and the completed position.

Further, as shown in FIG. 4, retaining arms 31 and 31 are formed on the movable aligner 11, and provisionally-retaining portions 33 are formed at that portion of the hood portion 9 corresponding to the provisional position (FIG. 5), and also completely-retaining portions 33 are formed at that portion of the hood portion 9 corresponding to the completed position (FIG. 7).

Further, a pair of guide portions 37 are formed on the movable aligner 11, and sliding movement guide walls 39 are formed on the hood portion 9. During the movement of the movable aligner 11 between the provisional position and the completed position, the sliding movement guide walls 39 slide relative to the respective guide portions 37 to guide the movable aligner 11 to thereby prevent the same from being inclined.

Next, the construction of the connector 1, as well as the fitting operation and the fitting cancellation operation, will be described.

Engagement grooves 41 and 41 are formed in the female connector 3 (that is, in the hood portion 9), and projections 43 for fitting in the respective engagement grooves 41 when the male connector 5 is inserted into the hood portion 9 are formed on the male connector 5. The engagement grooves 41, when engaged with the respective projections 43, position the two connectors 3 and 5 relative to each other in the fitting operation. When the fitting of the male terminals 6 to the respective female terminals is finished, each projection 43 abuts against an innermost end of the engagement groove 41, thereby stopping the movement of the male connector 5 so that the male connector 5 will not unnecessarily push the movable aligner 11.

The female terminals are received respectively in terminal receiving chambers 47 of the male connector 5, and the male terminals 6 are received respectively in terminal receiving chambers 49 of the connector body 7 of the female connector 3. As shown in FIG. 8, before the male connector 5 and the female connector 3 are fitted together (that is, before the female terminals and the male terminals 6 are fitted together), the movable aligner 11 is disposed in the provisional position within the hood portion 9, and supports the distal end portions of the male terminals 6 so as to align these distal end portions with the respective female terminals.

For fitting the female terminals to the respective male terminals 6, the male connector 5 is inserted into the hood portion 9 of the female connector 3, so that the pushing projections 21 begin to press the respective arms 13 as shown in FIG. 9. Then, when the male connector 5 is further pushed into the hood portion 9, the slanting surface 25 of each pushing projection 21 presses the arm 13 to cause the regulating projections 15 to be retained in the recess portion 19 as shown in FIGS. 10 to 12, and each pushing projection 21 is engaged in the slit 17 as shown in FIG. 13, and the male connector 5 contacts the movable aligner 11 while starting the fitting of the male terminals 6 to the respective female terminals as shown in FIG. 14, and the movable aligner 11 is further pushed by the male connector 5 from the provisional position to the completed position as shown in FIGS. 15 and 16, thereby completing the fitting of the male terminals 6 to the respective female terminals.

In this fitting operation, the retaining arms 31 of the movable aligner 11 disposed in the provisional position are retainingly engaged with the respective provisionally-retaining portions 33 of the hood portion 9, thereby holding the movable aligner 11 in the provisional position so as to further enhance the function of aligning the male terminals 6 with the respective female terminals. And besides, at the time when each pushing projection 21 causes the corresponding regulating projections 15 to be retained in the recess portion 19, the retaining engagement of the retaining arms 31 with the respective provisionally-retaining portions 33 prevents the movable aligner 11 from moving toward the completed position.

Furthermore, the movement of the movable aligner 11 is guided by the engagement of the guide ribs 27 with the respective guide grooves 29 (of the male connector 5) and the sliding contact of the guide portions 37 with the respective sliding movement guide walls 39 (of the hood portion 9), and therefore the movable aligner 11 can be smoothly moved without being inclined.

For canceling the fitted condition of the female terminals and male terminals 6, the male connector 5 is moved toward the opening of the hood portion 9 while canceling the fitted condition of the male terminals 6 and female terminals, and each pushing projection 21 is brought into contact with the arm 13, and the male connector 5 causes the movable aligner 11 to begin to move toward the provisional position as shown in FIG. 17. Then, when the male connector 5 is further drawn outward, the retaining engagement of the retaining arms 31 (of the movable aligner 11) with the respective completely-retaining portions 35 of the hood portion 9 is canceled, and the movable aligner 11 is moved to a position just before the provisional position as shown in FIG. 18, and then the movable aligner 11 is moved to the provisional position as shown in FIG. 19, so that each pushing projection 21 begins to press the arm 13, and then the slanting surface 25 of the pushing projection 21 displaces the arm 13 as shown in FIG. 20, thereby causing the regulating projections 15 of each arm 13 to be retained in the recess portion 19, and the retaining engagement of each pushing projection 21 with the arm 13 is canceled as a result of displacement of the arm 13 (see FIG. 20), so that the male connector 5 is ready to be moved alone toward the opening of the hood portion 9 while leaving the movable aligner 11 in the provisional position; as shown in FIG. 21.

In this fitting cancellation operation, as described above for the fitting operation, the movement of the movable aligner 11 is guided by the engagement of the guide ribs 27 with the respective guide grooves 29 and the sliding contact of the guide portions 37 with the respective sliding movement guide walls 39, and therefore the movable aligner 11 can be smoothly moved without being inclined.

The connector 1 can achieve the following advantages.

When fitting the female terminals to the respective male terminals 6, the arms 13 of the movable aligner 11 disposed in the provisional position are displaced respectively by the pushing projections 21 of the male connector 5, thereby retaining the regulating projections 15 in the recess portions 19 of the hood portion 9. Therefore, the movable aligner 11 is held in the provisional position, and therefore the female terminals and the male terminals 6 are properly fitted together by the movable aligner 11 which has the positioning function of supporting the distal end portions of the male terminals 6 so as to align these distal end portions with the respective female terminals.

For canceling the fitted condition, the male connector 5 is drawn outward, and as a result the movable aligner 11 is moved to the provisional position, so that each pushing projection 21 causes the regulating projections 15 of each arm 13 to be retained in the recess portion 19, thereby preventing the movable aligner 11 from being withdrawn from the hood portion 9.

Thus, in the fitting operation, the male terminals 6 can be positively aligned with the respective female terminals by the movable aligner 11, and in the fitting cancellation operation, the movable aligner 11 can be positively returned to the provisional position and can be held there.

Furthermore, during the returning movement of the movable aligner 11 from the completed position to the provisional position, the restorable arm displacement limitation ribs 23 formed on the hood portion 9 contact the corresponding regulating projections 15, respectively, thereby preventing the displacement of the arms 13 and the cancellation of engagement of each pushing projection 21 with the slit 17 which cancellation would be caused by this displacement, and therefore the movable aligner 11 is prevented from being left in a position just before the provisional position.

Therefore, when the female connector 3 and the male connector 5 are to be again fitted together, the movable aligner 11 held in the provisional position can positively align the male terminals 6 with the respective female terminals so that the male terminals 6 can be properly fitted to the respective female terminals.

Furthermore, thanks to a wedge effect of the slanting surfaces 25 and 25 formed on each pushing projection 21, the function of the pushing projection 21 (which is brought into contact with the arm 13 so as to retain the regulating projections 15 in the recess portion 19 to thereby hold the movable aligner 11 in the provisional position) is enhanced. Therefore, when fitting the female connector 3 and the male connector 5 together, the male terminals 6 can be positively aligned respectively with the female terminals by the movable aligner 11. When canceling the fitted condition, the movable aligner 11 can be positively prevented from being withdrawn from the hood portion 9.

Furthermore, the movable aligner 11 is guided by the guide grooves 29 and 29 through the guide ribs 27 and 27, and is prevented from being inclined. Therefore, the movable aligner 11 can be smoothly moved between the provisional position and the completed position.

Furthermore, the movable aligner 11 is held in the provisional position by the retaining arms 31 engaged respectively with the provisionally-retaining portions 33 of the hood portion 9, and also is held in the completed position by the retaining arms 31 engaged respectively with the completely-retaining portions 35 of the hood portion 9. Particularly thanks to the function of holding the movable aligner 11 in the provisional position, the function of aligning the male terminals 6 with the respective female terminals is properly maintained.

Furthermore, in the operation for fitting the female and male connectors 3 and 5 together, when each pushing projection 21 of the male connector 5 is to cause the regulating projections 15 of the movable aligner 11 (disposed in the provisional position) to be retained in the recess portion 19, the retaining engagement of the retaining arms 31 with the respective provisionally-retaining portions 33 positively prevents the movable aligner 11 from being accidentally moved toward the completed position. Also, when canceling the fitted condition of the female and male connectors 3 and 5, the retaining engagement of the retaining arms 31 with the respective completely-retaining portions 35 positively prevents the movable aligner 11 from being withdrawn from the hood portion 9.

Furthermore, during the movement of the movable aligner 11 between the provisional position and the completed position, the sliding movement guide walls 39 guide the respective guide portions 37, thereby preventing the movable aligner 11 from being inclined, and therefore the movable aligner 11 can be moved smoothly, and the function of aligning the male terminals 6 with the respective female terminals in the provisional position is normally maintained.

Furthermore, in contrast with the conventional connector using the three pairs of arms, the connector of the invention is prevented from becoming large in size.

What is claimed is:

1. A connector comprising:

a first connector including a connector body in which a first terminal is accommodated and a hood portion to which a tip of the first terminal is exposed, the hood portion including an inner wall on which a recess portion is provided;

a second connector to be inserted into and deserted from the hood portion, which accommodates a second terminal and has a pushing projection; and a movable aligner movable between a provisional position and a completed position by the insertion and desertion of the second connector into the hood portion, and including an arm which is flexibly deformable toward the inner wall, the arm including a slit and a regulating projection, wherein at the provisional position, the pushing projection pushes the arm toward the inner wall so that the arm deforms and the regulating projection is in the recess portion, and the movable aligner supports the tip of the first terminal so as to align with the second terminal;

during a movement between the provisional position to the completed position, the pushing projection is engaged with the slit; and at the completed position, the first and the second terminals are connected.

2. The connector according to claim 1, wherein the hood portion includes a regulating rib which contacts with the regulating projection to prevent the arm from deforming.

3. The connector according to claim 1, wherein the pushing projection includes a slant surface contacting with the arm at the provisional position.

4. The connector according to claim 2, wherein the pushing projection includes a slant surface contacting with the arm at the provisional position.

5. The connector according to claim 1, wherein the movable aligner includes a guide rib and the second connector includes a guide groove with which the guide rib is engaged so as to guide the movement between the provisional position and the completed position.

6. The connector according to claim 2, wherein the movable aligner includes a guide rib and the second connector includes a guide groove with which the guide rib is engaged so as to guide the movement of the movable aligner between the provisional position and the completed position.

7. The connector according to claim 3, wherein the movable aligner includes a guide rib and the second connector includes a guide groove with which the guide rib is engaged so as to guide the movement between the provisional position and the completed position.

8. The connector according to claim 1, wherein the movable aligner includes an engaging arm and the hood portion includes a provisional retaining portion provided at a position corresponding to the provisional position of the movable aligner and a completely retaining portion provided at a position corresponding to the completed position of the movable aligner, wherein the retaining arm is retained to the provisional retaining portion and the completed retaining portion when the movable aligner is at the provisional position and the completed position respectively.

9. The connector according to claim 2, wherein the movable aligner includes a retaining arm and the hood portion includes a provisional engaging portion provided at a position corresponding to the provisional position of the movable aligner and a completely retaining portion provided at a position corresponding to the completed position of the movable aligner, wherein the retaining arm is retained to the provisional retaining portion and the completed retaining portion when the movable aligner is at the provisional position and the completed position respectively.

10. The connector according to claim 3, wherein the movable aligner includes an engaging arm and the hood portion includes a provisional engaging portion provided at a position corresponding to the provisional position of the movable aligner and a completed engaging portion provided at a position corresponding to the completed position of the movable aligner, wherein the retaining arm is retained to the provisional retaining portion and the completed retaining portion when the movable aligner is at the provisional position and the completed position respectively.

11. The connector according to claim 4, wherein the movable aligner includes an engaging arm and the hood portion includes a provisional engaging portion provided at a position corresponding to the provisional position of the movable aligner and a completed engaging portion provided at a position corresponding to the completed position of the movable aligner, wherein the retaining arm is retained to the provisional retaining portion and the completed retaining portion when the movable aligner is at the provisional position and the completed position respectively.

12. The connector according to claim 1, wherein the movable aligner includes a guiding portion and the hood portion includes a guiding wall on which the guiding portion slides during the movement of the movable aligner between the provisional position and the completed position.

13. The connector according to claim 2, wherein the movable aligner includes a guiding portion and the hood portion includes a sliding wall on which the guiding portion slides during the movement of the movable aligner between the provisional position and the completed position.

14. The connector according to claim 3, wherein the movable aligner includes a guiding portion and the hood portion includes a guiding wall on which the guiding portion slides during the movement of the movable aligner between the provisional position and the completed position.

15. The connector according to claim 4, wherein the movable aligner includes a guiding portion and the hood portion includes a guiding wall on which the guiding portion slides during the movement of the movable aligner between the provisional position and the completed position.

16. The connector according to claim 5, wherein the movable aligner includes a guiding portion and the hood portion includes a guiding wall on which the guiding portion slides during the movement of the movable aligner between the provisional position and the completed position.

* * * * *

UNITED STATES PATENT AND TRADEMARK OFFICE

CERTIFICATE OF CORRECTION

PATENT NO. : 7,828,583 B2
APPLICATION NO. : 12/562863
DATED : November 9, 2010
INVENTOR(S) : Ohsumi et al.

It is certified that error appears in the above-identified patent and that said Letters Patent is hereby corrected as shown below:

Title Page, Item (75) Inventor is corrected to read:
-- Hideki Ohsumi, Utsunomiya (JP);
Kazuto Ohtaka, Makinohara (JP);
Hideki Honma, Tokyo (JP);
Tetsuya Mitani, Wako (JP) --.

Signed and Sealed this
Sixth Day of October, 2015

Michelle K. Lee

Michelle K. Lee
*Director of the United States Patent and Trademark Office*